US012529146B2

(12) United States Patent
Chen et al.

(10) Patent No.: US 12,529,146 B2
(45) Date of Patent: Jan. 20, 2026

(54) PRETREATMENT METHOD OF ALUMINUM ALLOY COIL

(71) Applicants: Jun Chen, Shanghai (CN); Shanghai Mingjie Chem-Technologies Co., Ltd, Shanghai (CN)

(72) Inventors: Jun Chen, Shanghai (CN); Jie Chen, Shanghai (CN); Conglin Xia, Shanghai (CN); Ruijie Mao, Shanghai (CN)

(73) Assignees: Jun Chen, Shanghai (CN); Shanghai Mingjie Chem-Technologies Co., Ltd., Shanghai (CN)

( * ) Notice: Subject to any disclaimer, the term of this patent is extended or adjusted under 35 U.S.C. 154(b) by 439 days.

(21) Appl. No.: 18/128,280

(22) Filed: Mar. 30, 2023

(65) Prior Publication Data

US 2024/0175139 A1 May 30, 2024

(30) Foreign Application Priority Data

Nov. 30, 2022 (CN) ..... 202211528567.7

(51) Int. Cl.
*C23C 22/78* (2006.01)
*C23C 22/03* (2006.01)

(52) U.S. Cl.
CPC ..... *C23C 22/78* (2013.01); *C23C 22/03* (2013.01)

(58) Field of Classification Search
CPC ..... C23C 22/78; C23C 22/03; C23C 22/56; C23C 22/73; C23C 1/00; C23C 1/125; C23C 1/22; C23F 1/20; B08B 3/02
See application file for complete search history.

(56) References Cited

FOREIGN PATENT DOCUMENTS

CN 106271035 A * 1/2017 ..... B21B 1/38

OTHER PUBLICATIONS

Machine translation, CN-106271035-A (Year: 2017).*
Qu ("Effect of water content on corrosion inhibition behavior of self-assembled TDPA on aluminum alloy surface", Qu et al., Trans. Nonferrous Met. Soc. China 23(2013) 3137-3144). (Year: 2013).*

* cited by examiner

*Primary Examiner* — Michael G Miller
(74) *Attorney, Agent, or Firm* — Jose Cherson Weissbrot

(57) ABSTRACT

The invention relates to the technical field of aluminum alloy surface treatment, in particular to the technical field of IPC C23C, and more specifically to a pretreatment method of an aluminum alloy coil. The invention can improve adhesion of an adhesive and weldability of an aluminum alloy at the same time through a specific pretreatment method combined with a specific treatment solution, and an aluminum alloy substrate after pretreatment has good compatibility with subsequent permanent anti-corrosion treatment, so that the pretreatment method is very suitable for welding or bonding of aluminum alloy parts of automobile bodies.

9 Claims, 1 Drawing Sheet

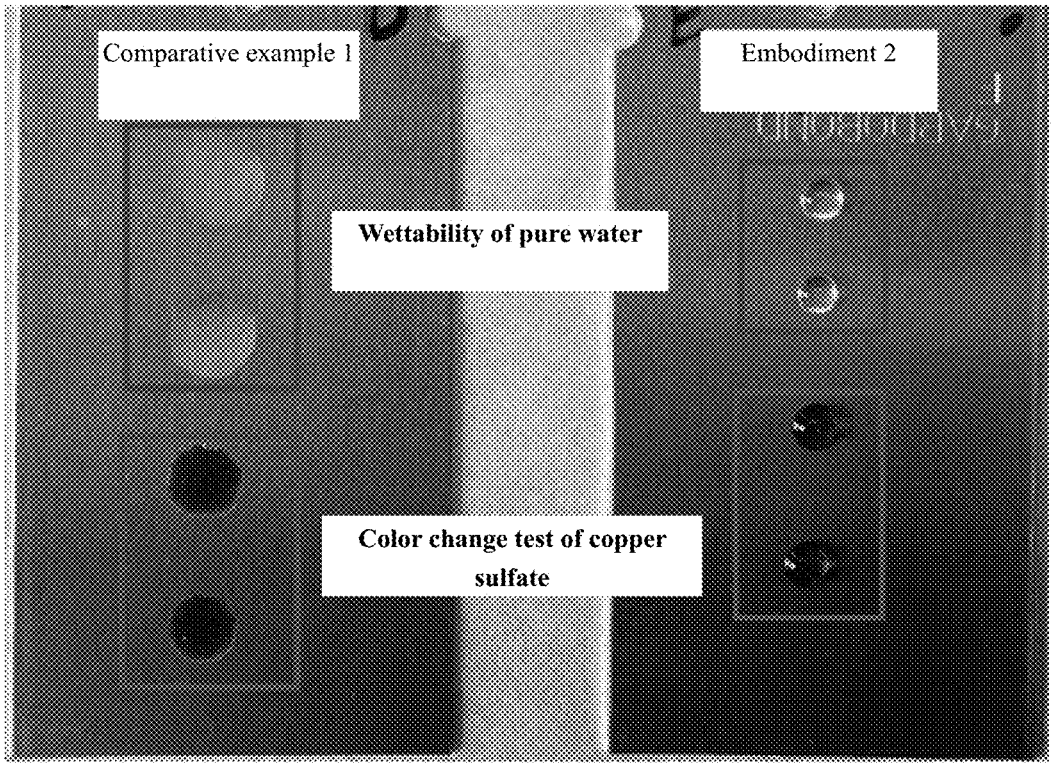
Comparative example 1
Embodiment 2
Wettability of pure water
Color change test of copper sulfate

PRETREATMENT METHOD OF ALUMINUM ALLOY COIL

TECHNICAL FIELD

The invention relates to the technical field of aluminum alloy surface treatment, in particular to the technical field of IPC C23C, and more specifically to a pretreatment method of an aluminum alloy coil.

BACKGROUND

In the automobile market in recent years, the new energy automobile industry represented by Tesla has developed rapidly, and with the vigorous implementation and application of the sustainable development strategy, automobile lightweight has become the world's development trend. In view of the following application advantages of aluminum alloy materials: 1. the significant effect of weight reduction, energy conservation and environmental protection: 2. easy recycling: 3. safety and comfort improvement of passengers. Therefore, in the process of automobile lightweight, the application of aluminum alloy materials is more and more popular.

At present, aluminum alloy parts of automobile bodies are mainly connected to other parts (aluminum alloy parts, galvanized parts, steel parts, iron parts) through welding and/or adhesive bonding or assembly, and then the assembled parts are subject to permanent anti-corrosion treatment (phosphating pretreatment or chrome-free conversion film pretreatment, and then coating). Therefore, more and more automobile manufacturers pay attention to the bonding and welding properties of aluminum alloy material surfaces and the compatibility with the subsequent permanent anti-corrosion treatment.

So far, the main pretreatment technologies in the market to improve the bonding and welding properties of the aluminum alloy material surfaces of automobile bodies include Gardobond X4591 technology and ALCOA 951 technology. Gardobond X4591 technology is a trademark product of Chemetall. Its main components are fluorozirconic acid and fluorotitanic acid. At present, it is mainly applied in European and American car series and Chinese new energy vehicles. Gardobond X4591 technology can prevent the increase of surface resistance of the pretreated aluminum alloy during storage, and has good welding performance. However, since it does not contain effective organic substances, the adhesive has a general bonding performance. ALCOA 951 technology is a trademark product of Aluminum Company of America. Its core component is vinyl phosphonic acid-acrylic polymer copolymers. At present, it is mainly applied in Ford's all aluminum pickup truck bodies (F150) and Tesla's battery bottom plates. ALCOA 951 technology has an excellent adhesive bonding performance and can pass Ford's rigorous APGE test. However, due to super hydrophilicity of the pretreatment conversion film formed on the aluminum alloy surface, the surface resistance of the pretreated aluminum alloy increases rapidly during storage, which seriously affects the welding performance of the aluminum alloy.

SUMMARY

In order to solve the above problems, the first aspect of the invention provides a pretreatment method of an aluminum alloy coil, including:

S1. cleaning a surface of the aluminum alloy coil;

S2. washing the surface of the aluminum alloy coil with deionized water;

S3. treating the surface of the aluminum alloy coil with a treatment solution;

S4. washing the surface of the aluminum alloy coil with deionized water; and

S5. drying.

Preferably, a material of the aluminum alloy coil includes any one of 1XXX series aluminum alloy, 2XXX series alloy, 3XXX series aluminum alloy, 4XXX series aluminum alloy, 5XXX series aluminum alloy, 6XXX series aluminum alloy and 7XXX series aluminum alloy; further preferably, it is any one of AA3003 aluminum alloy, AA5754 aluminum alloy, AA5005 aluminum alloy, AA5182 aluminum alloy, AA6451 aluminum alloy, AA6111 aluminum alloy, AA6014 aluminum alloy and AA6016 aluminum alloy.

Preferably, the cleaning in the step S1 is either a one-step method or a two-step method.

Preferably, a specific implementation of the one-step method is as follows: treating the aluminum alloy with an acidic degreasing and etching two-in-one solution.

Preferably, a specific implementation of the two-step method is as follows: degreasing the aluminum alloy coil with a degreasant, washing it with water, and then etching the coil with an etchant.

Preferably, an etching rate during degreasing is 0.0-0.2 $g/m^2$.

Preferably, a use temperature of the degreasant is 20-70° C.

Preferably, the degreasant is an alkaline degreasant and water.

Preferably, a weight of the alkaline degreasant is 1-7 wt % of the degreasant.

Preferably, the alkaline degreasant includes a phosphorus-containing inorganic salt, potassium carbonate, a chelating agent and a non-ionic surfactant.

Preferably, a concentration ratio of the phosphorus-containing inorganic salt, potassium carbonate, the chelating agent and the non-ionic surfactant is (8-12):(3-8):(1-3):1.

Preferably, the phosphorus-containing inorganic salt includes one or two of potassium pyrophosphate and sodium tripolyphosphate.

Preferably, a concentration ratio of potassium pyrophosphate and sodium tripolyphosphate is 1:1.

Preferably, the chelating agent includes sodium gluconate.

Preferably, the non-ionic surfactant includes one or more of a fatty alcohol polyether non-ionic surfactant, an alkyl phenol polyoxyethylene ether non-ionic surfactant, a fatty acid polyoxyethylene ester non-ionic surfactant, a polyoxyethylene alkyl amine non-ionic surfactant, polyoxyethylene alkyl amide non-ionic surfactant and a polyether non-ionic surfactant; further preferably, it is a fatty alcohol polyether non-ionic surfactant.

Preferably, a hydroxyl value of the fatty alcohol polyether non-ionic surfactant is 70-110 mg KOH/g, and a cloud point (1% solution) is 20-40° C.; further preferably, a hydroxyl value of the fatty alcohol polyether non-ionic surfactant is 85-95 mg KOH/g, and a cloud point (1% solution) is 28-31° C.

In some preferred solutions, the fatty alcohol polyether non-ionic surfactant is Dehypon LS 54 produced by BASF.

Preferably, a use temperature of the etchant is 20-70° C.

Preferably, an etching rate during the etching is 0.1-0.5 $g/m^2$.

Preferably, the etchant is an aqueous solution of a mixture of an inorganic acid, a fluoride and a non-ionic surfactant.

Preferably, a concentration ratio of the inorganic acid, the fluoride and the non-ionic surfactant is (15-35):(1-3):1; further preferably, it is 125:8:5.

Preferably, the inorganic acid includes one or more of a sulfuric acid aqueous solution, a phosphoric acid aqueous solution and a nitric acid aqueous solution; further preferably, it is a sulfuric acid aqueous solution.

Preferably, a concentration of sulfuric acid in the sulfuric acid aqueous solution is 98 wt %.

Preferably, the fluoride includes one or more of ammonium bifluoride, hydrofluoric acid and fluorosilicic acid; further preferably, it is ammonium bifluoride.

The inventor accidentally finds that the subsequent welding performance can be improved by the two-step cleaning. This may be because the specific degreasant can remove the oil stains and solid particles on the surface of the aluminum alloy coil, while the specific etchant can remove the oxide layer on the surface of the aluminum alloy coil, which, combined with the subsequent steps, slows the growth of the oxide layer on the surface of the pretreated aluminum alloy coil, thus reducing the surface resistance and improving the welding performance of the aluminum alloy coil in the subsequent industrial production. The surface resistance can be further reduced by increasing the etching rate during etching, but a higher etching amount consumes more chemicals, which increases pretreatment costs.

Preferably, a conductivity of deionized water in the step S2 is less than 50 μs/cm.

In the invention, deionized water with low conductivity is selected to wash the surface of the aluminum alloy coil, which, on the one hand, is to remove the chemical agents on the surface of the aluminum alloy, and on the other hand, is to prevent the chemical agents from polluting the treatment solution and affecting the film formation of the phosphonic compound solution on the surface of the aluminum alloy coil, thus affecting the pretreatment effect.

Preferably, the treatment solution in the step S3 is a phosphonic compound solution.

Preferably, a content of an organic phosphorus compound in the organic phosphorus compound solution is 0.0001-0.1 mol/L; further preferably, it is 0.0003-0.003 mol/L.

Preferably, a structure of the phosphonic compound is $(OH)_2OP—(CH_2)_X—PO(OH)_2$, and $—(CH_2)_X—$ is a saturated straight-chain alkyl group, where X is 8-16, preferably 10-14.

Preferably, the phosphonic compound consists of phosphonic compounds with one or more structures of $(OH)_2OP—(CH_2)_X—PO(OH)_2$, and $—(CH_2)_X—$ is a saturated straight-chain alkyl group, where X is 8-16, preferably 10-14.

Preferably, a use temperature of the phosphonic compound solution is 20-99° C.; further preferably, it is 50-70° C.

Preferably, treatment time of the phosphonic compound solution is 3 s-60 s; further preferably, it is 4 s-20 s.

Preferably, a pH value of the phosphonic compound solution is 1.5-6.5; further preferably, it is 2-4.

Preferably, the treating of the step S3 is any of spraying, dipping and roller coating; further preferably, it is either spraying or dipping.

Preferably, the application of the phosphonic compound solution is spraying or dipping or roller coating, preferably spraying or dipping.

The invention uses the solution containing a specific phosphonic compound as the treatment solution to treat the surface of the aluminum alloy coil, which can improve the corrosion resistance of the aluminum alloy surface and at the same time improve the adhesion between the aluminum alloy surface and the adhesive. This may be because the active groups in the specific phosphonic compound can form chemical bonds with the surface of the aluminum alloy substrate to form a film, which can slow down the electrochemical reaction and thus play a corrosion inhibition effect, and on the other hand, can play the role of adhesion promoter for the organic components in the adhesive. The corrosion resistance can be improved by increasing the content of organic phosphorus compounds in an organic phosphorus compound, but its impact on the corrosion resistance is limited, and an excessively high content will also affect the treatment cost.

Preferably, a conductivity of deionized water in the step S4 is less than 50 μs/cm.

Preferably, a drying temperature PMT of the step S5 is 60-180° C.; further preferably, it is 80-120° C.

Preferably, drying time of the step S5 is 0.5-30 min.

The second aspect of the invention provides an application of the pretreatment method of the aluminum alloy coil, where the pretreatment method is applied to an automobile field; further, it is applied to welding or bonding of aluminum alloy parts of automobile bodies.

Beneficial Effects 1. the invention can improve the subsequent welding performance through the two-step cleaning.
2. in the invention, deionized water with low conductivity is selected to wash the surface of the aluminum alloy coil, which, on the one hand, is to remove the chemical agents on the surface of the aluminum alloy, and on the other hand, is to prevent the chemical agents from polluting the treatment solution and affecting the film formation of the phosphonic compound solution on the surface of the aluminum alloy coil, thus affecting the pretreatment effect.
3. the invention uses the solution containing a specific phosphonic compound as the treatment solution to treat the surface of the aluminum alloy coil, which can improve the corrosion resistance of the aluminum alloy surface and at the same time improve the adhesion between the aluminum alloy surface and the adhesive.
4. the invention can improve the adhesion of the adhesive and the weldability of the aluminum alloy at the same time through the specific pretreatment method combined with the specific treatment solution, and the aluminum alloy substrate after pretreatment has good compatibility with the subsequent permanent anti-corrosion treatment, so that the pretreatment method is very suitable for the welding or bonding of aluminum alloy parts applied to automobile bodies.

BRIEF DESCRIPTION OF THE DRAWINGS

FIG. 1 shows an aluminum alloy surface treated by a pretreatment method of Embodiment 2 (right) and Comparative example 1 (left).

DESCRIPTION OF THE EMBODIMENTS

Embodiments

Embodiment 1

Embodiment 1 provides a pretreatment method of an aluminum alloy coil, including:

S1. cleaning a surface of the aluminum alloy coil;

S2. washing the surface of the aluminum alloy coil with deionized water;

S3. treating the surface of the aluminum alloy coil with a treatment solution;

S4. washing the surface of the aluminum alloy coil with deionized water; and

S5. drying.

A material of the aluminum alloy coil is AA5005 aluminum alloy.

The cleaning in the step S1 is a two-step method.

A specific implementation of the two-step method is as follows: degreasing the aluminum alloy coil with a degreasant, washing it with water, and then etching the coil with an etchant.

A use temperature of the degreasant is 50° C.

The degreasant is an alkaline degreasant and water.

The alkaline degreasant is 5 g/L potassium pyrophosphate, 5 g/L sodium tripolyphosphate, 5 g/L potassium carbonate, 2.0 g/L sodium gluconate and 1.0 g/L non-ionic surfactant.

The non-ionic surfactant is a fatty alcohol polyether non-ionic surfactant.

A hydroxyl value of the fatty alcohol polyether non-ionic surfactant is 85-95 mg KOH/g, and a cloud point (1% solution) is 28-31° C.

The fatty alcohol polyether non-ionic surfactant is Dehypon LS 54 produced by BASF.

A use temperature of the etchant is 28° C.

An etching rate during the etching is 0.1 g/m$^2$.

The etchant is an aqueous solution of a mixture of an inorganic acid, a fluoride and a non-ionic surfactant.

The etchant is 6 g/L 98 wt % sulfuric acid, 0.4 g/L 98 wt % ammonium hydrogen fluoride and 0.25 g/L non-ionic surfactant.

A conductivity of deionized water in the step S2 is less than 50 μs/cm.

The treatment solution in the step S3 is a phosphonic compound solution.

A content of an organic phosphorus compound in the organic phosphorus compound solution is 0.0006 mol/L.

A structure of the phosphonic compound is $(OH)_2OP—(CH_2)_X—PO(OH)_2$, and $—(CH_2)_X—$ is a saturated straight-chain alkyl group, wherein X is 12.

A use temperature of the phosphonic compound solution is 55° C.

Treatment time of the phosphonic compound solution is 30 s.

A pH value of the phosphonic compound solution is 3.

The treating of the step S3 is dipping.

Dipping time of the step S3 is 30 s.

A conductivity of deionized water in the step S4 is less than 50 μs/cm.

A drying temperature PMT of the step S5 is 80° C.

Drying time of the step S5 is 10 min.

Embodiment 2

Embodiment 2 provides a pretreatment method of an aluminum alloy coil, and the specific implementation is the same as that of Embodiment 1. The difference is that an etching rate during the etching is 0.2 g/m$^2$.

Embodiment 3

Embodiment 3 provides a pretreatment method of an aluminum alloy coil, and the specific implementation is the same as that of Embodiment 1. The difference is that an etching rate during the etching is 0.3 g/m$^2$.

Comparative Example 1

Comparative example 1 provides a pretreatment method of an aluminum alloy coil, and the specific implementation is the same as that of Embodiment 2. The difference is that the treatment solution in the step S3 is the treatment solution recorded in the US Patent MS00602003OA, a phosphorus content in the treatment solution is 1.5 g/L, a temperature of a bath solution is 55° C., a pH of the bath solution is 1.5, and dipping time is 30 s.

Comparative Example 2

Comparative example 2 provides a pretreatment method of an aluminum alloy coil, and the specific implementation is the same as that of Embodiment 2. The difference is that the treatment solution in the step S3 is the treatment solution GB X4591A2 recorded in the US Patent MS006562148B, a concentration of the treatment solution in a bath solution is 50 g/L, a temperature of the bath solution is 28° C., a pH of the bath solution is adjusted to 3.8 with GBA H7271, and dipping time is 6 s.

Embodiment 4

Embodiment 4 provides a pretreatment method of an aluminum alloy coil, and the specific implementation is the same as that of Embodiment 2. The difference is that a content of an organic phosphorus compound in the organic phosphorus compound solution is 0 mol/L.

Embodiment 5

Embodiment 5 provides a pretreatment method of an aluminum alloy coil, and the specific implementation is the same as that of Embodiment 2. The difference is that a content of an organic phosphorus compound in the organic phosphorus compound solution is 0.00015 mol/L.

Embodiment 6

Embodiment 6 provides a pretreatment method of an aluminum alloy coil, and the specific implementation is the same as that of Embodiment 2. The difference is that a content of an organic phosphorus compound in the organic phosphorus compound solution is 0.0003 mol/L.

Embodiment 7

Embodiment 7 provides a pretreatment method of an aluminum alloy coil, and the specific implementation is the same as that of Embodiment 2. The difference is that a content of an organic phosphorus compound in the organic phosphorus compound solution is 0.001 mol/L.

Embodiment 8

Embodiment 8 provides a pretreatment method of an aluminum alloy coil, and the specific implementation is the same as that of Embodiment 2. The difference is that a content of an organic phosphorus compound in the organic phosphorus compound solution is 0.0015 mol/L.

Performance Test Method

1. Surface Resistance Performance Test

The surface resistance of the pretreated aluminum alloy coils using the aluminum alloy coils described in Embodiments 1-3 and Comparative examples 1-2 is measured, and the pretreated aluminum alloy coils continue to be measured for the surface resistance after being kept at 85° C. and 85% humidity for 15 days, and the measurement results are recorded in Table 1.

TABLE 1

Surface resistance performance test data

| | Surface resistance μΩ | |
|---|---|---|
| | Initial | After 15 days |
| Embodiment 1 | 59 | 35 |
| Embodiment 2 | 45 | 30 |
| Embodiment 3 | 29 | 20 |
| Comparative example 1 | 40 | 228 |
| Comparative example 2 | 49 | 173 |

It can be seen from the resistance test that the aluminum alloy coil treated with the solution of the application can inhibit the growth of the surface oxide layer, thereby reducing the surface resistance and improving the subsequent welding performance. It can be seen from solutions 1-3 that the amount of pickling etching increases, the surface resistance value decreases, but a higher etching amount consumes more chemicals, which increases the cost of pretreatment.

2. Wettability Test

Wettability test: a drop of pure water is dropped on the surfaces of the pretreated aluminum alloy coils using the aluminum alloy coils described in Embodiment 2 and Comparative example 1, and the wettability of pure water is observed. The results are shown in FIG. 1. It can be observed that the surface of Embodiment 2 is extremely hydrophobic, and the surface of Comparative example 1 is extremely hydrophilic in the application.

Copper sulfate color change test: a copper sulfate reagent is prepared, including 40 ml of 2% copper sulfate pentahydrate, 20 ml of 2% sodium chloride, 0.2 ml of 0.1 g/L hydrochloric acid, 0.8 ml of deionized water, and a pH of the solution is about 4.3. The copper sulfate reagent is dropped on the surfaces of the pretreated aluminum alloy coils using the aluminum alloy coils described in Embodiment 2, Comparative example 1, Embodiments 4-8. Color change time of copper sulfate is observed. The initial color of color change is: light blue; the end color is: reddish brown. The color change time is recorded in Table 2.

TABLE 2

Color change time of copper sulfate

| | Color change time of copper sulfate/s |
|---|---|
| Embodiment 2 | 75 |
| Comparative example 1 | 35 |
| Embodiment 4 | 35 |
| Embodiment 5 | 50 |
| Embodiment 6 | 73 |

TABLE 2-continued

Color change time of copper sulfate

| | Color change time of copper sulfate/s |
|---|---|
| Embodiment 7 | 75 |
| Embodiment 8 | 75 |

It can be seen from the wettability test that the reason for the high surface resistance of the aluminum alloy coil after treatment of Comparative example 1 during storage may be that its surface is extremely hydrophilic, and the aluminum alloy coil after treatment of Embodiment 2 of the application has a long color change time, indicating that the corrosion resistance of the aluminum alloy coil pretreated by the method of the application is better than that of Comparative Example 1. As the content of a phosphonic compound in the phosphonic compound solution increases, the color change time of copper sulfate tends to be stable, indicating that the content of the phosphonic compound has a limited influence on the color change time of copper sulfate, and the excessively high content of phosphonic will increase the cost.

3. Adhesive Performance Test

For the pretreated aluminum alloy coils (AA6016) using the aluminum alloy coils described in Embodiment 2 and Comparative Example 1, the shear strength and T-peel strength between it and epoxy structural adhesive TEROSON EP 5089 are tested. The test conditions are 720 h of salt spray and 10 days after 54° C. water, respectively. The test method of shear strength is: single lap joint, bonding area 25*12.5*0.2 mm, tensile speed 10 mm/min. The test method of T-peel strength is: single lap joint, bonding area 25*100*0.2 mm, stretching speed 50 mm/min. The results are recorded in Table 3.

TABLE 3

Adhesive performance test form
Adhesive performance test

| | | Test results | |
|---|---|---|---|
| Test items | Test conditions | Embodiment 2 | Comparative example 1 |
| Shear strength Mpa | Salt spray resistance | 23.1 | 22.5 |
| | Water resistance | 24 | 22.7 |
| T-peel strength N/mm | Salt spray resistance | 7.5 | 7.1 |
| | Water resistance | 7.3 | 6.6 |

It can be seen from Table 3 that the shear strength and T-peel strength between the aluminum alloy coil after pretreatment of Embodiment 2 of the application and the adhesive are high, and the adhesive performance is better than that of the aluminum alloy coil after treatment of Comparative example 1, indicating that the aluminum alloy coil surface treated by the application has excellent adhesion with the epoxy structural adhesive.

4. Compatibility Test

Phosphating pretreatment is carried out on Embodiment 2 and the unpretreated aluminum plate (AA5754), respectively, and then the morphology of a phosphating film is observed with the help of a scanning electron microscope to judge the compatibility with phosphating pretreatment. The process of phosphating pretreatment is as follows: degreasing with Gardoclean 5176 produced by Chemetall at 55° C. for 3 min, rinsing the surface with tap water, and adjusting the surface with Gardolene V6513 surface conditioner, after phosphating with Gardobond 2600 at 55° C. for 3 min, washing with water, and drying at 80° C. for 10 min. The results are recorded in Table 4.

TABLE 4

| Compatibility test data | |
|---|---|
| | Morphology of a phosphating film |
| Embodiment 2 Pretreated test plate | Closed, fine crystals |
| Unpretreated test plate | Closed, fine crystals |

It can be seen from Table 4 that the surface morphology of the phosphating film formed after the phosphating pretreatment of the aluminum alloy coil after the pretreatment of the application is consistent with that after the phosphating treatment of the untreated aluminum alloy coil, indicating that the pretreated aluminum alloy substrate has good compatibility with the subsequent permanent anti-corrosion treatment, which makes the pretreatment method very suitable for the welding or bonding of the alloy parts of automobile bodies.

What is claimed is:

1. A pretreatment method of an aluminum alloy coil, comprising:

S1 cleaning a surface of the aluminum alloy coil;

S2 washing the surface of the aluminum alloy coil with deionized water;

S3 treating the surface of the aluminum alloy coil with a treatment solution;

S4 washing the surface of the aluminum alloy coil with deionized water; and

S5 drying, wherein treatment solution in the step S3 is a phosphonic compound solution, with one or more phosphonic compound structures of $(OH)_2OP—(CH_2)_X—PO(OH)_2$, and $—(CH_2)_X—$ is a saturated straight-chain alkyl group, and X is 8-16.

2. The pretreatment method of an aluminum alloy coil according to claim 1, wherein a material of the aluminum alloy coil comprises any one of 1XXX series aluminum alloy, 2XXX series alloy, 3 XXX series aluminum alloy, 4XXX series aluminum alloy, 5XXX series aluminum alloy, 6XXX series aluminum alloy and 7XXX series aluminum alloy.

3. The pretreatment method of an aluminum alloy coil according to claim 1, wherein the cleaning in the step S1 is either a one-step method or a two-step method.

4. The pretreatment method of an aluminum alloy coil according to claim 3, wherein the two-step method comprises: degreasing the aluminum alloy coil with a degreasant, washing it with water, and then etching the coil with an etchant.

5. The pretreatment method of an aluminum alloy coil according to claim 4, wherein the degreasant comprises an alkaline degreasant and water; a weight of the alkaline degreasant is 1-7 wt % of the degreasant; the alkaline degreasant comprises a phosphorus-containing inorganic salt, potassium carbonate, a chelating agent and a non-ionic surfactant.

6. The pretreatment method of an aluminum alloy coil according to claim 4, wherein a use temperature of the etchant is 20-70° C.; an etching rate during the etching is 0.1-0.5 $g/m^2$; the etchant is an aqueous solution of a mixture of an inorganic acid, a fluoride, and a non-ionic surfactant.

7. The pretreatment method of an aluminum alloy coil according to claim 1, wherein a content of a phosphonic compound in the phosphonic compound solution is 0.0001-0.1 mol/L.

8. The pretreatment method of an aluminum alloy coil according to claim 7, wherein treatment time of the phosphonic compound solution is 3 s-60 s; a pH value of the phosphonic compound solution is 1.5-6.5.

9. An application of the pretreatment method of an aluminum alloy coil according to claim 1, wherein the pretreatment method is applied to an automotive field.

* * * * *